US010596631B2

(12) United States Patent
Taylor et al.

(10) Patent No.: US 10,596,631 B2
(45) Date of Patent: Mar. 24, 2020

(54) METHOD OF FORMING A COMPOSITE COMPONENT USING POST-COMPACTION DIMENSIONAL CHANGE

(71) Applicant: GKN Sinter Metals, LLC, Auburn Hills, MI (US)

(72) Inventors: Alan C. Taylor, Lake Orion, MI (US); Ian W. Donaldson, Madison, NH (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 156 days.

(21) Appl. No.: 15/562,550

(22) PCT Filed: Mar. 31, 2016

(86) PCT No.: PCT/US2016/025258
§ 371 (c)(1),
(2) Date: Sep. 28, 2017

(87) PCT Pub. No.: WO2016/164250
PCT Pub. Date: Oct. 13, 2016

(65) Prior Publication Data

US 2018/0111201 A1 Apr. 26, 2018

Related U.S. Application Data

(60) Provisional application No. 62/145,773, filed on Apr. 10, 2015.

(51) Int. Cl.
*B22F 7/06* (2006.01)
*B22F 5/10* (2006.01)

(52) U.S. Cl.
CPC ..... *B22F 7/062* (2013.01); *B22F 5/106* (2013.01); *B22F 7/06* (2013.01)

(58) Field of Classification Search
None
See application file for complete search history.

(56) References Cited

U.S. PATENT DOCUMENTS 3,837,068 A * 9/1974 Dunn ..... B22F 7/062 29/505
4,539,197 A * 9/1985 Asaka ..... B22F 7/062 228/131

(Continued)

FOREIGN PATENT DOCUMENTS

CN 1141961 A 2/1997
GB 2 063 721 A 6/1981

(Continued)

OTHER PUBLICATIONS (1998) P.W. Lee et al. ASM Handbook, vol. 7: Powder Metal Technologies and Applications. (pp. 343) (Year: 1998).*

(Continued)

*Primary Examiner* — Jessee R Roe
*Assistant Examiner* — Joshua S Carpenter
(74) *Attorney, Agent, or Firm* — Quarles & Brady LLP

(57) ABSTRACT

A method includes the sequential steps of compacting a powder metal in a tool and die set using a compaction press to form a powder metal compact, ejecting the powder metal compact from the tool and die set, positioning the powder metal compact relative to another part, and cooling the powder metal compact. When the powder metal is compacted, a temperature of the powder metal used to form the powder metal compact increases relative to ambient temperature due to deformation of the powder metal during compacting. After ejection and while the powder metal compact is still above ambient temperature, the compact is positioned relative to the other part. Then, upon the cooling of the powder metal compact, the powder metal compact dimensionally shrinks to form an interference fit between the (Continued)

powder metal compact and the other part thereby forming the composite component, which may be subsequently sintered.

15 Claims, 2 Drawing Sheets

(56) References Cited

U.S. PATENT DOCUMENTS

| | | | | |
|---|---|---|---|---|
| 9,662,708 | B2 * | 5/2017 | Schmitt | B22F 3/03 |
| 2004/0195092 | A1 | 10/2004 | D'Astolfo, Jr. | |
| 2012/0214014 | A1 * | 8/2012 | Schmitt | B22F 3/03 428/553 |

FOREIGN PATENT DOCUMENTS

| | | | |
|---|---|---|---|
| JP | S558470 | A | 1/1980 |
| JP | H06-330108 | A | 11/1994 |
| WO | 2011/089117 | A2 | 7/2011 |

OTHER PUBLICATIONS (2012). H.M. Cobb. Dictionary of Metals—sigma (σ) phase. (pp. 205). ASM International. (Year: 2012).*

Merriam Webster online dictionary. Definition of Solid. Retrieved May 10, 2019. (Year: 2019).*

China National Intellectual Property Administration, First Office Action and Search Report, Application No. 201680021201.7, dated Feb. 2, 2019, 19 pages.

International Searching Authority, PCT International Search Report and Written Opinion for corresponding International Application No. PCT/US2016/025258, dated Jul. 12, 2016, 10 pages.

* cited by examiner

METHOD OF FORMING A COMPOSITE COMPONENT USING POST-COMPACTION DIMENSIONAL CHANGE

CROSS-REFERENCE TO RELATED APPLICATION

This application represents the national stage entry of International Application No. PCT/US2016/025258 filed Mar. 31, 2016, and claims the benefit of the filing date of U.S. Provisional Patent Application No. 62/145,773 entitled "Method of Producing Composite Components Using Post-Compaction Dimensional Change" filed on Apr. 10, 2015, which is hereby incorporated by reference for all purposes as if set forth in its entirety herein.

STATEMENT OF FEDERALLY SPONSORED RESEARCH OR DEVELOPMENT

Not applicable.

FIELD OF THE INVENTION

This disclosure relates to powder metallurgy. In particular, this disclosure relates to methods of forming composite components by assembly of at least one newly compacted "green" compact and another component immediately after production of the compact.

BACKGROUND

Powder metallurgy is commonly used to produce high-volume components with good dimensional control. Typically, a powder metal and some amount of binder and/or lubricant are compacted in a tool and die set in order to form a "green" or un-sintered powder metal compact or preform. Such compacts or preforms are then heated to sintering temperatures just below the melting temperatures of the powder metal in order to cause the powder metal particles to sinter to one another. This sintering usually involves adjacent particles necking into one another to join or bond the powder metal particles to one another while, at the same time, reducing the porosity of the component and increasing its density. In some forms, the sintering step may include "liquid phase" sintering in which at least one of the powder metal constituents is engineered to melt into a liquid phase at sintering temperatures, thereby additionally providing liquid phase for transport at sintering temperatures. In any event, the sintering process forms a sintered powder metal component which is much stronger than the green compact or preform and which has exceptional dimensional accuracy as compared to parts made by other processes, such as for example, casting. In many instances, this sintered powder metal component is further processed by one or more of machining, forging, and so forth.

Although sintered powder metal components have their advantages, there are certain circumstances in which a single sintered powder metal component does not possess all of the desired properties for a particular application. In such circumstances, composite components are often used in which more than one material is used to produce the component. As one example, in order to form bi-material composite parts, pressing techniques have been developed in which multiple powder metals are filled into a single die and tool set (using complex dividers, for example) and then these materials are simultaneously compacted.

Nonetheless, known processes for production of composite components typically add severe complexity to existing process steps and/or add the need for additional fixtures to enable the formation of the composite. Further, even in the simplest case of diffusion bonding of two components, in which two components are placed adjacent to one another during the sintering step for at least one of the components, there are potentially concerns with consistent and accurate placement of the two constituent portions relative to one another as, if there is not a consistent interface quality between the portions, the sinter bonding may be relatively poor.

Thus, there exists a need for improvements in the field of powder metal composite component production.

SUMMARY OF THE INVENTION

A method is disclosed herein which takes advantage of the temporary heat generated by the work of deformation of the powder metal during the compaction process and subsequent dimensional shrinkage upon cooling of the compact in a method of forming a composite component. Effectively, while the as-compacted part is still warm from compaction, it is assembled with a second component. Upon dissipation of the heat (that is cooling) from the as-compacted part, which results in a small amount of dimensional shrinkage, the powder metal compact is interference fit onto the second component. These joined parts can then be sintered together in order to firmly bond the two parts together.

According to one aspect of the invention, a method is disclosed of forming a composite component. The method includes the sequential steps of compacting a powder metal in a tool and die set using a compaction press to form a powder metal compact, ejecting the powder metal compact from the tool and die set, positioning the powder metal compact relative to another part, and cooling the powder metal compact. Notably, the timing and sequence of these steps are significant in that, when the powder metal is compacted, a temperature of the powder metal used to form the powder metal compact increases relative to ambient temperature due to deformation of the powder metal during compacting. After ejection and while the powder metal compact is still above ambient temperature, the compact is positioned relative to the other part. Then, upon the cooling of the powder metal compact, the powder metal compact dimensionally shrinks to form an interference fit joining the powder metal compact and the other part thereby forming the composite component.

The method may further include, after cooling the powder metal compact, sintering the composite component. During sintering, the powder metal compact may form at least a portion of a sintered section of the composite component. It is contemplated that, in some forms, the other part may be another powder metal compact (albeit one having different geometry). In this instance, during the step of sintering, both of the powder metal compacts can be sintered simultaneously.

The step of sintering may also result in the diffusion bonding of a first section and a second section at an interface defined between the first section and the second section in which the first section of the composite component is formed by the sintering of the powder metal compact and the second section includes the other part. This interface between the first section and the second section at which the diffusion bonding occurs may correspond to an interface formed between the powder metal compact and the other part during the creation of the interference fit during cooling of the powder metal compact. It is contemplated that after sintering, other post-sintering steps might be performed such as, for example, heat treating the composite component.

In some forms of the method, the other part may be at ambient temperature prior to the step of positioning the powder metal compact relative to the other part or may be cooled to a temperature below ambient temperature prior to the step of positioning the powder metal compact relative to the other part. With the other part at or below ambient temperature prior to the positioning step, this means that the powder metal compact dimensionally shrinks onto the other part as the powder metal compact cools relative to the other part. In some forms, the other part might also be above ambient temperature before positioning, but in this case, the other part should be designed to dimensionally shrink less than the powder metal compact upon cooling to ensure the interference fit will form.

In some forms of the method, the powder metal part may have an inner periphery and the other part may have an outer periphery, and the inner periphery of the powder metal part and the outer periphery of the other part may have corresponding shapes that establish the interference fit after the cooling of the powder metal compact. In one specific form, the powder metal compact may be annular in shape; however other shapes may also work.

The other part may take one of a number of different forms. As noted above, the other part could also be a powder metal part, and it is contemplated this powder metal part might be sintered simultaneously with the powder metal compact or might be centered prior to the positioning and cooling that forms the interference fit. However, the other part may also be a solid, fully dense part such as a cast or extruded part, for example.

It is also contemplated that in some forms of the method, the powder metal compact may be heated or kept warm between the ejecting and positioning steps. Such heating may prevent the powder metal compact from immediately cooling (or cooling to such an extent that the cooling prevents the placement of the powder metal compact relative to the other part for the subsequent formation of the interference fit).

It is also contemplated that in some forms, the powder metal compact may not cool to ambient temperature prior to the step of positioning the powder metal compact relative to the other part. Put another way, the positioning may occur without any re-heating between ejection and positioning such that the heating utilized is generated primarily from the compaction process.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENTS

Figure 1:
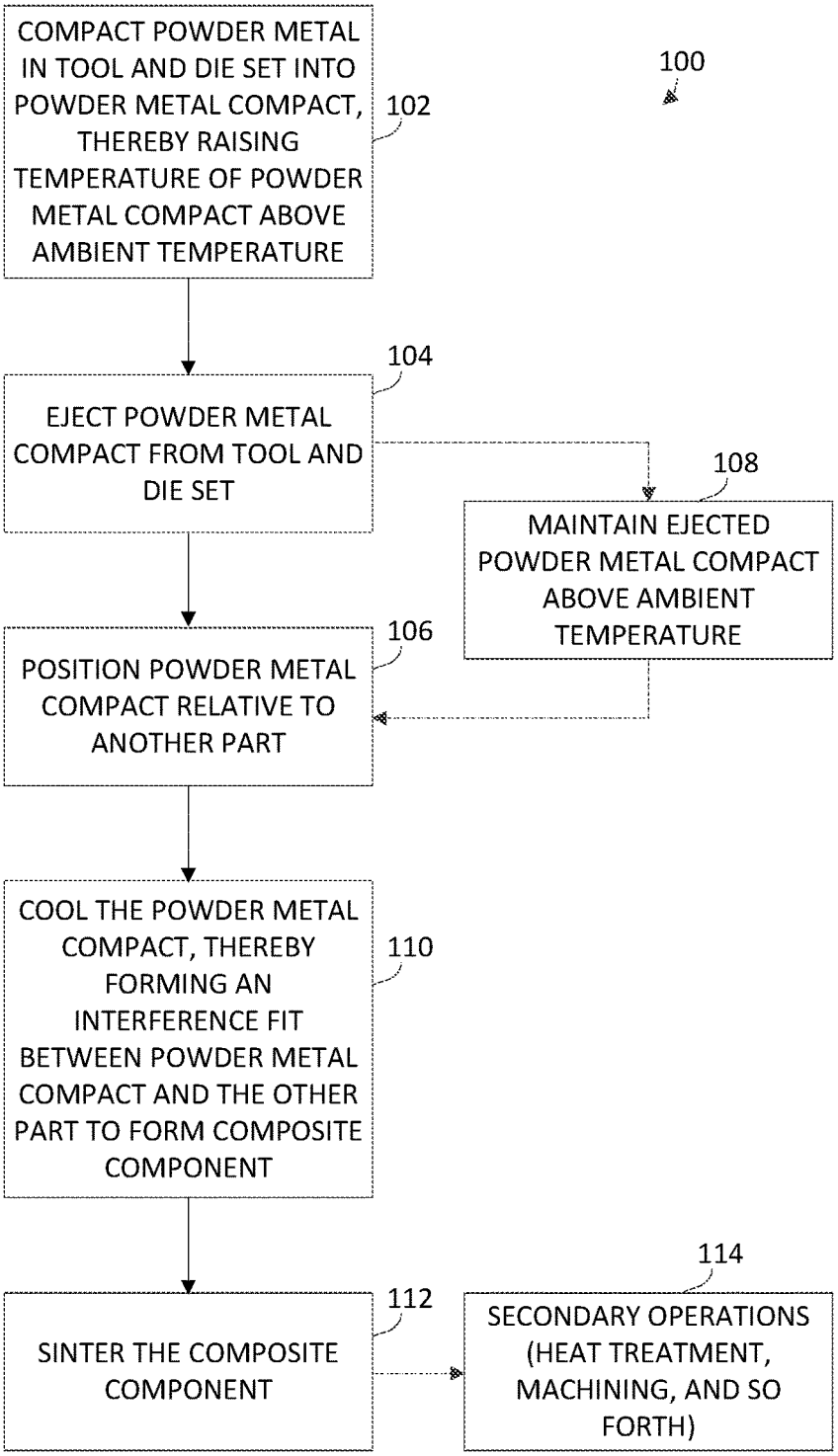
FIG. 1 is a block diagram illustrating the steps of the method of forming the composite component.

Referring first to FIG. 1, a method 100 is illustrated for the production of a composite component that includes at least one powder metal portion. The other portion(s) of the composite component, as will be described in greater detail below, might be powder metal as well, but might also be non-powder metal portions that are, for example, cast, extruded, or so formed in other ways.

According to the method 100 in FIG. 1, a powder metal is first filled into a tool and die set and is then, as indicated in step 102, compacted in the tool and die set to form a powder metal compact. This powder metal includes one or more powder metal constituents (which may be a homogenous powder metal or may be mixes or blends of various heterogeneous powder metals) and typically is presented with a lubricant and/or binder that helps to maintain the form of the as-compacted powder metal prior to sintering as well as to facilitate the subsequent ejection of the powder metal compact from the tool and die set.

Those having ordinary skill in the art are well apprised of various powder metal compaction methods although one exemplary method will now be described. In one conventional form of powder metal compaction, a lower tool set is placed in a cavity of a die to form a bottom floor. Powder metal may then be filled into this die cavity using a feed shoe. With the feed shoe withdrawn, an upper set of tools are lowered into the cavity of the die, and a uni-axial compaction pressure is applied to the powder metal by the upper and lower tools as they are brought towards one another.

This is but one known method of compaction. There are numerous variations on how this compaction step and such variations are certainly contemplated as falling within the described compaction step.

Notably, during the compaction step, the powder metal particles are worked and deformed, which generates heat which warms the part above ambient temperature. This heat is generated by the working and deformation of the particles, which noticeably warms the produced powder metal compacts.

As used herein, "ambient temperature" is used to describe a temperature of the surrounding environment, but not of the powder metal immediately post-compaction or of the processing equipment itself. In most contexts, ambient temperature will be the room temperature in which the process occurs. Given that powder metallurgy is often practiced in factory conditions with furnaces throughout the facility, it is possible that in at least some circumstances, the ambient temperature may be around or in excess of 100 degrees Fahrenheit. It will be appreciated that "ambient temperature" is a relative term which is contextual to the operational environment.

With the part compacted according to step 102, the powder metal compact is then ejected from the tool and die set according to step 104. Conventionally, this ejection involves the withdrawal of the upper tool members from the die and the lifting of the lower tool members to be flush with the upper surface of the die. At this time, a lateral pusher element may move the powder metal compact away and apart from the compaction tooling and onto, for example, a conveyor belt or otherwise towards an operator for handling.

It should be appreciated that in addition to any heat generated by the work and deformation of the powder metal during compaction, that some amount of heat may be generated during step 104 during the ejection of the powder metal compact from the tool and die set. This heat may be generated by the frictional engagement of the tool and die set and the powder metal compact as the powder metal compact is ejected from the tooling. Particularly in the production of large volumes of compacts, this cyclic compaction and ejection of the powder metal compact in and from the tool and die set can create significant amounts of heat that are imparted to both the powder metal compact as well as the tool and die set itself. Accordingly, for those conditions in which friction plays a significant role in heating, it may be appropriate to perform a number of compaction cycles to initially elevate the temperature of the tooling and result in compact-to-compact temperatures which are relatively consistent.

As some non-limiting examples of temperatures of just-pressed powder metal compacts, the temperature of compacts typically would run from about 125 to 165 degrees Fahrenheit. Electric heating cartridges or fluid with temperature control (for example, channels in die) can increase or control temperature. There are some lubricants which can operate at 225 degrees Fahrenheit so the temperature of the just-pressed compacts can be significantly elevated without heating powder. The maximum temperature for heated powder or heated tools would be 450° F. using special lubricant. Therefore, there are a wide range of potentially applicable temperatures for the as-pressed compacts. To provide ballpark estimates of expansion rates for some ferrous materials, the coefficient of thermal expansion is about $5.9\times10^{-6}$/° F. in the temperature range of room temperature to approximately 200 degrees Fahrenheit or about $6.4\times10^{-6}$/° F. from room temperature to 400 degrees Fahrenheit.

Figure 2A:
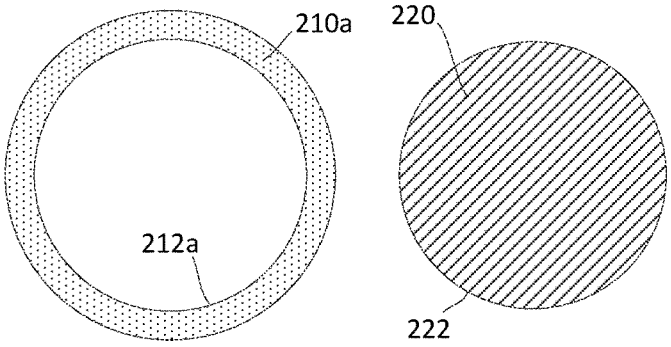
FIG. 2A through 2D schematically illustrate portions of the method illustrated in FIG. 1.
Figure 2B:
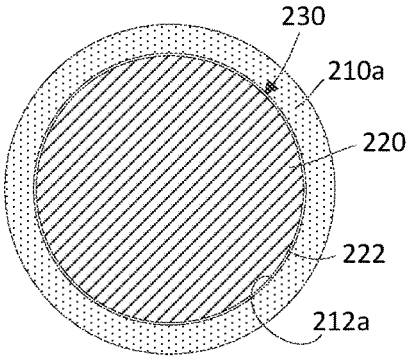

With the powder metal compact ejected from the tool and die set, this still-warm powder metal compact is positioned relative to another part according to step 106 and further as schematically illustrated, for example, sequentially in FIGS. 2A and 2B in which the powder metal compact 210*a* and the other part 220 are first separate from one another and then positioned relative to one another, respectively. With the powder metal compact 210*a* still warm, as illustrated in FIGS. 2A and 2B, the powder metal compact 210*a* is slightly dimensionally larger than the powder metal compact 210*b* after cooling due to thermal expansion, which is subsequently illustrated in FIG. 2C after cooling and dimensions have slightly decreased. In the still-warm condition, an inner periphery 212*a* of the powder metal compact 210 can be placed around an outer periphery 222 of the other part 220 as shown in FIG. 2B. In the particular form schematically illustrated, the powder metal compact 210*a* is generally tubular, while the other part 220 is cylindrical. The inner periphery 212*a* of the powder metal compact 210*a* and the outer periphery 222 of the other part 220 closely correspond to one another in shape and dimension, although the inner periphery 212*a* of the powder metal compact 210*a* is still slightly larger than the outer periphery 222 of the other part 220 when the powder metal compact 210*a* is still warm from compaction and ejection to create an inter-component volume or gap 230 between the inner periphery 212*a* of the powder metal compact 210*a* and the outer periphery 222 of the other part 220. This dimensional difference may be relatively small in view of the steps that follow. For example, the difference in diameter between the inner periphery 212*a* and the outer periphery 222 may be less than 1% of the total diameter dimension.

It should be appreciated that the illustrated shapes of the inner and outer peripheries are only exemplary. Other shapes of peripheries, whether completely matching or only partially matching might be employed instead of circular cross sections.

Further, it will be appreciated that while the other part 220 is illustrated as being a full dense part, that the other part 220 may be any one of a number of types of parts whether powder metal or non-powder metal. If the other part 220 is powder metal, then the other part 220 may be either sintered or un-sintered at the step 106 of positioning.

It is also contemplated that, optionally, between the ejection of the powder metal compact from the tool and die set according to step 104 and the positioning of the powder metal compact relative to another part according to step 106, the powder metal compact may be maintained above ambient temperature according to optional step 108. Maintaining the temperature of the powder metal compact above ambient temperature may potentially involve using temporary warmers or using thermally insulating conveying mechanisms to ensure that the powder metal compact does not cool to an impermissible extent (that is, one in which the powder metal compact can no longer be positioned relative to another part according to step 106 due to the dimensional shrinkage associated with cooling) prior to the step 106 of positioning the powder metal compact relative to the other part. Further yet, it is contemplated that the powder metal or the tool and die set may itself be warmed, such as during warm compaction, to achieve a green compact with an elevated temperature.

It is contemplated that the other part can be at ambient temperature during the position step 106, may be below ambient temperature (possibly using cooling mechanisms), or may even be slightly above ambient temperature. Regardless of the temperature of the other part at the time of positioning, the powder metal compact and the other part should be initially positionable relative to one another, such that, the result described in the following step can be achieved to form an interference fit between the powder metal compact and the other part.

Figure 2C:
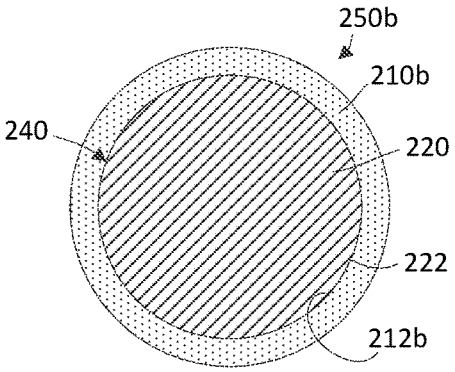

After the powder metal compact and the other part are positioned with respect to one another as in step 106, the powder metal compact is permitted to cool according to step 110. By cooling the powder metal compact, the powder metal compact experiences a small amount of dimensional shrinkage due to thermal contraction. This is illustrated in FIG. 2C in which the powder metal part 210*b* has cooled to shrink onto the other part 220, which has remained relatively dimensionally stable in the meanwhile, to eliminate the inter-component gap 230 and form an interference fit 240 at the interface between the inner periphery 212*b* of the powder metal compact 210 and the outer periphery 222 of the other part, thereby forming a composite component 250*b*. Accordingly, a small, but significant, amount of dimensional change occurs in the powder metal compact as it cools from 210*a* to 210*b* (the diameter of inner periphery 212*a* in the warm compact 210*a* is greater than the diameter of the inner periphery 212*b* in the cooled compact 210*b*) to create the interference fit between the parts of the composite component 250*b*.

It should be noted that a green powder metal compact easily maintains its form under gentle handling; however, under the application of some force it is possible to crumble or fracture the green compact. For example, dropping a green compact on a hard surface from a few feet would typically cause the compact to fracture into multiple sections or chip. This structural integrity or lack thereof should be kept in mind when engineering the parts to be joined given that, as the interference fit is formed, some amount of stress will be applied to the green compact (for example, in the hoop direction in the case of a tubular green compact). Accordingly, the dimensions of the components should be selected such that when an interference fit is generated upon cooling, that the force applied to create and maintain the interference fit does not structurally damage the green compact. Accordingly, there is a balance to be made in order to achieve the interference fit without damaging the green component.

It is also noted that as the cooling occurs, some amount of heat may transfer from the compact to the other part, thereby not only resulting in thermal contraction of the powder metal compact, but also at least temporary thermal expansion of the other part. Depending on the rates of the thermal expansion of the two portions, it is contemplated that the cooling does not need to be fully to ambient temperature and that, especially if the other part has a greater rate of thermal expansion than the powder metal compact, that it may be possible or even preferable to maintain the joined components at a temperature above ambient temperature to maintain or promote the interference fit.

After the interference fit has been established according to step 110, then a step of sintering 112 the composite component may occur to sinter at the powder metal compact fit onto the other part as well as, potentially, the other part (if the other part is also powder metal). Sintering occurs by heating the composite component 250*b* to just below the melting temperature of at least one of the constituents of the powder metal compact 210*b*. The structural change of the sintering step 112 is reflected between FIGS. 2C and 2D in which the cooled, un-sintered powder metal compact 210*b* is sintered to form the sintered powder metal portion 210*c* of the composite component 250*c*, which both also include the other part 220.

Figure 2D:
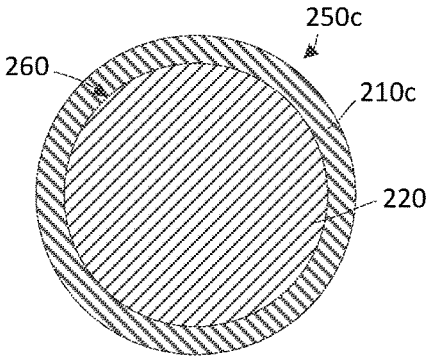

During sintering, at the prior interface of the interference fit 240, a diffusion-bonded region 260 may be created (generally depicted by the line 260 in FIG. 2D, although in fact such interface is a diffusion gradient). This diffusion-bonded region 260 forms a strong metallurgical bond between the sintered powder metal portion 210*c* and the other part 220. Further, to the extent that an interference fit 240 preceded the sintering, there is exceptional surface-to-surface contact between the precursor surfaces of the inner periphery 212*b* and the outer periphery 220 that enhances the strength of the diffusion-bonded region 260.

It is further observed that during sintering, the powder metal compact 210*b* has a tendency to dimensionally shrink as it densifies during sintering to form the sintered powder metal portion 210*c*. This further intensifies the interference fit and surface contact between the portions.

Subsequent to the step 112 of sintering, the composite component 250*c* may undergo additional secondary operations and post-sintering operations during a step 114 such as, for example, heat treatment, carburization, machining, forging, and so forth.

It will be appreciated that while a single instance of the formation of a composite component is illustrated having one powder metal portion and one non-powder metal portion, that variations are contemplated. Among other things, in addition to modifying the shapes and types of parts as noted earlier, it is contemplated that the composite component may include more than just two components as illustrated in FIGS. 2A-2D. For example, multiple powder metal components might be cooled to an interference fit on a single base part. As still another alternative, a single powder metal part might be cooled to form an interference fit between two other separate components to join them together, for example. Thus, numerous variations are contemplated and the depicted example should be considered illustrative, but not limiting.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method of forming a composite component, the method comprising the sequential steps of:

compacting a powder metal in a tool and die set using a compaction press to form a powder metal compact whereby, during compaction, a temperature of the powder metal used to form the powder metal compact increases relative to ambient temperature due to deformation of the powder metal during compacting;

ejecting the powder metal compact from the tool and die set;

positioning the powder metal compact relative to another part while the temperature of the powder metal compact is still above ambient temperature; and prior to sintering, cooling the powder metal compact, thereby resulting in dimensional shrinkage of the powder metal compact to form an interference fit between the powder metal compact and the other part thereby forming the composite component.

2. The method of claim 1, further comprising, after cooling the powder metal compact, sintering the composite component.

3. The method of claim 2, wherein the powder metal compact forms at least a portion of a sintered section of the composite component.

4. The method of claim 2, wherein the step of sintering results in the diffusion bonding of a first section and a second section at an interface defined between the first section and the second section, the first section of the composite component being formed by sintering of the powder metal compact and the second section including the other part.

5. The method of claim 4, wherein the interface between the first section and the second section at which the diffusion bonding occurs corresponds to an interface formed between the powder metal compact and the other part during creation of the interference fit during cooling of the powder metal compact.

6. The method of claim 2, further comprising, after the step of sintering, heat treating the composite component.

7. The method of claim 2, wherein the other part is another powder metal compact.

8. The method of claim 7, wherein, during the step of sintering, both of the powder metal compacts are sintered.

9. The method of claim 1, wherein the other part is at ambient temperature prior to the step of positioning the powder metal compact relative to the other part.

10. The method of claim 1, wherein the other part is cooled to a temperature below ambient temperature prior to the step of positioning the powder metal compact relative to the other part.

11. The method of claim 1, wherein the powder metal part has an inner periphery and the other part has an outer periphery and wherein the inner periphery of the powder metal part and the outer periphery of the other part have corresponding shapes that establish the interference fit after the cooling of the powder metal compact.

12. The method of claim 11, wherein the powder metal compact is annular in shape.

13. The method of claim 1, wherein the other part is a solid, fully dense part.

14. The method of claim 1, further comprising, between the steps of ejecting the powder metal compact and positioning the powder metal compact relative to the other part, heating the powder metal compact to prevent the powder metal compact from immediately cooling.

15. The method of claim 1, wherein the powder metal compact does not cool to ambient temperature prior to the step of positioning the powder metal compact relative to the other part.

* * * * *